US006016099A

United States Patent [19]

Campman

[11] Patent Number: 6,016,099

[45] Date of Patent: Jan. 18, 2000

[54] AUTOMATICALLY ACTIVE PERSONAL ALERT SAFETY SYSTEM

[76] Inventor: James P Campman, 329 Bendhill Rd., Fredonia, Pa. 16124

[21] Appl. No.: 09/097,819

[22] Filed: Jun. 16, 1998

[51] Int. Cl.[7] ..... G08B 23/00

[52] U.S. Cl. ..... 340/321; 340/573.1; 340/691.8; 340/384.73; 381/159

[58] Field of Search ..... 340/573.1, 321, 340/691.8, 384.73, 574, 547; 310/321; 381/159; 335/202, 205

[56] References Cited

U.S. PATENT DOCUMENTS

| | | | |
|---|---|---|---|
| 3,963,202 | 6/1976 | Hopkins | 246/125 |
| 4,389,635 | 6/1983 | Gallagher | 340/539 |
| 4,846,462 | 7/1989 | Regnier et al. | 340/573 |
| 5,317,305 | 5/1994 | Campman | 340/573 |
| 5,408,213 | 4/1995 | Ungarsohn | 340/547 |
| 5,640,148 | 6/1997 | Lewis et al. | 340/573 |
| 5,786,761 | 7/1998 | Hui | 340/547 |

*Primary Examiner*—Daniel J. Wu
*Assistant Examiner*—Anh La
*Attorney, Agent, or Firm*—Daniel K. Dorsey

[57] ABSTRACT

A problem of accounting for firefighters at a fire scene and also assuring that a firefighter has his PASS device turned on is an ever pressing issue. A tally key and holder, each with an embedded magnet, are designed to magnetically infiltrate a reed switch in the PASS device. Accordingly, the present invention provides a simple means of accounting for personnel and also assuring that their PASS devices are automatically turned on.

15 Claims, 4 Drawing Sheets

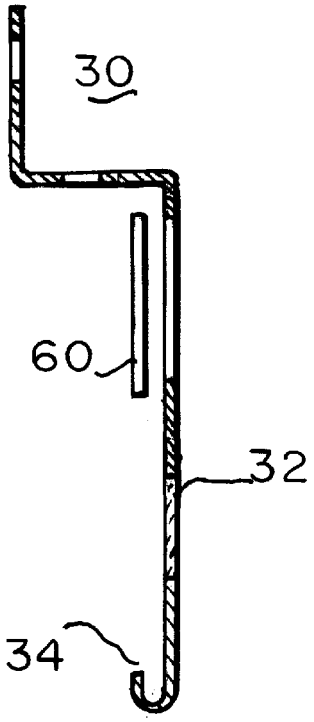
Fig. 2.
Fig. 4.
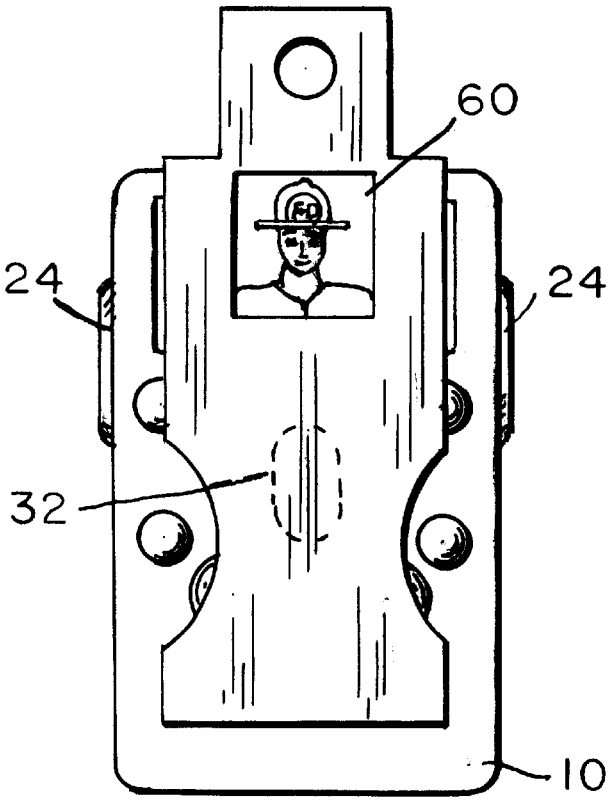
Fig. 3.
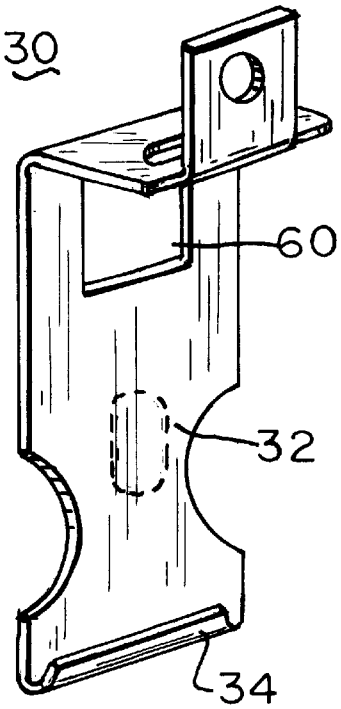

AUTOMATICALLY ACTIVE PERSONAL ALERT SAFETY SYSTEM

BACKGROUND OF THE INVENTION

1. Field of the Invention

The preset invention pertains to a small, lightweight personal alert safety system (Acronym is PASS) which has a self-contained battery powered electrical and electronic circuit, among other components, in a small casing for use by personnel working in dangerous environments, e.g., firefighters and rescue workers and the like.

2. Cross-Reference to Related Applications and Patents

My companion Design application Ser. No. 29/077,368, filed on Sep. 22, 1997, entitled HOLDING BRACKET, discloses a holder that grips the PASS securely and permits easy removal of the PASS alarm. Additionally, my U.S. Pat. No. 5,317,305 patented May 31, 1994, entitled PERSONAL ALARM DEVICE WITH VIBRATING ACCELEROMETER MOTION DETECTOR AND PLANAR PIEZOELECTRIC HI-LEVEL SOUND GENERATOR, discloses an alarm and lights which include a vibrating accelerator for motion detectors and a planar, low profile sealed, piezo hi-level sound generating transducer structurally and functionally coordinated with a resonating chamber casing structure to provide a hi-level audio alarm. These inventions are hereinafter incorporated by reference thereto.

The purpose of the PASS alarm is to sound a loud, highly discernible audio alarm if a distressful situation should occur, A PASS alarm can be activated either manually or automatically. When using a PASS alarm in the automatic mode of operation, the alarm will sense the absence of motion if the wearer should become immobilized for a predetermined (25 second) time period. The alarm will then sound a loud, easily recognized audio alarm that will not turn itself off unless it is manually reset. This sound serves as an audio beacon that aids others in finding the downed person (fireman). PASS alarms may also be manually activated to summon help. The devices are normally attached to a SCBA harness, a turnout coat or other protective clothing. A PASS alarm can be a lifesaving device when used properly by personnel involved in hazardous occupations such as fire fighting.

DESIRABLE FEATURES

PASS devices must be highly reliable and easy to operate. The demand for lighter, smaller and more reliable PASS devices and equipment is an ever-pressing issue for today's modern fire fighter. Features that must be considered are: SIZE, SHAPE AND WEIGHT; SOUND INTENSITY and TYPE of Sound; MOTION Detectors; Signal Processing; Temperature Alarms; Visual Indicators; Manual and Automatic Switching; and Attachments.

The PASS should have a small, lightweight, low profile shape with no sharp corners. Generally smaller physical size is more desirable, provided there is no reduction in sound output. PASS devices that are currently available range in weigh from 7 ounces to 13 ounces and exhibit sound intensities that range from 95 dBA through 101 dBA (dBA-unit of sound pressure related to loudness) at ten feet. The primary objective of a PASS device is to provide a loud, highly discernible sound that is easily heard and recognized under high ambient noise conditions. Two important parameters of sound that must be considered are sound loudness (intensity) measured in dBA and sound discernibility (the ability to recognize a particular sound in a high background noise environment). Some of the earlier PASS devices had a loud sound output (high dBA), but it was difficult to distinguish the source of the sound, and thus it was easily confused with smoke alarm sounds or other coherent sound sources. Present day PASS devices have overcome the problem of locating the source from which the sound signal is originating by modulating a pure tone or generating a sound that consists of several intermittent tones. Another, and possibly the most desirable audio sound, is that of a wave frequency (most discernible). This type of sound will generate multiple tones that sweep from two thousand cycles through six thousand cycles. It is not easily masked by background noise. The actual sound generators are usually of the piezoelectric type and are considered the best means for generating high sound levels.

Manufactures of PASS devices provide features as defined by the NFPA standard 1982, 1988 edition. This standard defines the minimum requirements and specifications for electronics for electronic and mechanical characteristics as well as environmental specifications.

The sensor that permits a PASS device to operate when in the automatic mode (responsive to motion or lack of it) is called a motion detector. These motion detectors are an extremely important part of a PASS device. If the sensor is not sensitive enough to sense random motion, the PASS alarm will constantly be going into a prealert condition, becoming an irritation to the wearer of the device. The ideal sensor is one that only requires normal motion to keep the PASS inhibited, yet will be sensitive enough to immediately sense lack of motion when a person is motionless. Some motion sensors that are currently used by manufactures of PASS devices are mechanical types that depend on movement of a small metal ball to sense motion. This random motion of the ball is then converted into an electrical signal as long as motion exists. Another popular method of sensing motion is accomplished by the closing of a mercury filled switch with respect to motion.

A third and possible more progressive method involves a solid-state accelerometer device that can sense a broad range of motion and is not position sensitive.

For the system circuitry, most PASS manufacturers use either a custom micro-chip or a micro-processor chip. Some chip functions are timing, automatic low battery sensing alarm, motion signal processing and sound generation. A quartz crystal is sometimes used to insure accurate timing.

Added features in PASS devices, not covered by the NFPA mandated are: high temperature sensing and alarms; visual indicators; switches; and attachment devices.

Heat sensing alarms that are an integrated part of a PASS device, sound an audio alarm, different from the automatic PASS alarm sound, when life threatening temperatures are encountered. Those PASS devices equipped with temperature sensing alarms should only be regarded as a relative indicator that life threatening temperatures may exist, and are not to be interpreted as an absolute indicator. Temperature sensing PASS devices typically operate on an integrated time versus temperature scheme, and are dependent upon the thermal inertia of the PASS device type of heat sensor used, and the logistics at the fire scene. Accuracy at temperatures that heat alarm will sound can vary as much as ±25% because of the aforementioned.

Most PASS devices are provided with a flashing LED indicator. This indicator provides the user with a visual beacon, but perhaps more important, it can serve as an indicator that the PASS electronics are functioning properly. Most manufactures provide a visual indicator. The most common indicator is a blinking LED or a combination of LED's that are programmed to flash in a wig-wag fashion for ease of recognition.

Some manufactures utilize a mechanical switch to activate their PASS devices. These switches must be reliable and easy to manipulate, even with a gloved hand. A more recent improvement in switching is used in my patented invention, U.S. Pat. No. 5,317,305 and is the all-electronic switch (no moving parts).

Attachment devices vary with different PASS manufacturers. Captive clips are designed to fit the SCBA harness. This type of attachment device does not adapt itself for easy attachment to turnout coats and other gear. Other types of attachment devices include D-rings and fast acting grip clips. The grip clip may be considered the most universal since it permits attaching the pass device to clothing, belts or harnesses by affixing itself with a clamp-like "clop" action. All of the aforementioned attachment devices serve the purpose for which they were designed.

A discussion of personal alarm devices which show one or more of the aforementioned desirable features can be found in my U.S. Pat. No. 5,317,305 which is incorporated by reference.

The problem of accounting for firefighters at the fire scene and also assuring that a firefighter has his PASS device turned on is an ever pressing issue. The following device as described addresses these problems and provides a simple means of accounting for personnel and also assuring that their PASS devices are automatically turned on.

SUMMARY OF THE INVENTION

The present invention assists the firefighter to assure that the light, smaller and reliable PASS device is automatically turned on. The present invention works with a personal alert safety system having a reed switch and alarm means indicative of personal safety conditions. The invention uses a tally key made of a tough, transparent polycarbonate plastic that has a permanent magnet embedded in it. The magnet magnetically infiltrates the reed switch when the tally key is fastened to the PASS device. The spring action of the tally key allows it to attach to the front part of the PASS unit via a key retaining lip and the key retaining bump, both located on the PASS unit. According to one part of the invention, this tally key may be tethered to any stationary object and when the PASS device is placed on one's person, the tally key will snap off of the PASS unit and automatically activate the PASS.

The present invention also utilizes a holding bracket to store the PASS unit. The bracket is made of a plastic material having properties similar to polycarbonate. The plastic material from which this device is made, must have a good spring action, be extremely rugged and able to withstand harsh environments. The holding bracket contains an embedded magnet similar in operation as to the magnet in the tally key so that when the reed switch of the PASS is in magnetic contact with the holding bracket the switch will be opened.

It is an object of the invention to provide a key retaining bump positioned on a top portion of the PASS device and a key retaining slot positioned on a front face portion of the device.

It is a further object of the invention that a magnetically activated reed switch is positioned on the front face portion of the casing above the key retaining slot and electrically connected thereto.

It is an object of the invention to utilize a magnetically activated reed switch which includes a collector with a ground potential representing a first open position, and a base with a ground potential representing a second closed position.

A further object is to have an inverted L-shaped tally key with a top portion having a retaining aperture to securely mate with the retaining bump of the PASS device and a bottom portion of the inverted L-shape having a retaining lip for securely fitting into the retaining slot of the PASS device.

Further novel features and other objects of this invention will become apparent from the following detailed description, discussion and the appended claims taken in conjunction with the accompanying drawings.

BRIEF DESCRIPTION OF THE DRAWINGS

A preferred structural system embodiment and preferred subcomponents of this invention are disclosed in the accompanying drawings in which:

FIG. 2 is a right side elevational view of the tally key of the present invention.

FIG. 3 is a rear perspective view of the tally key of the present invention.

FIG. 4 is a front elevation view of the alarm device and the tally key in direct communication with each other.

DETAILED DESCRIPTION OF THE DRAWINGS

Figure 1:
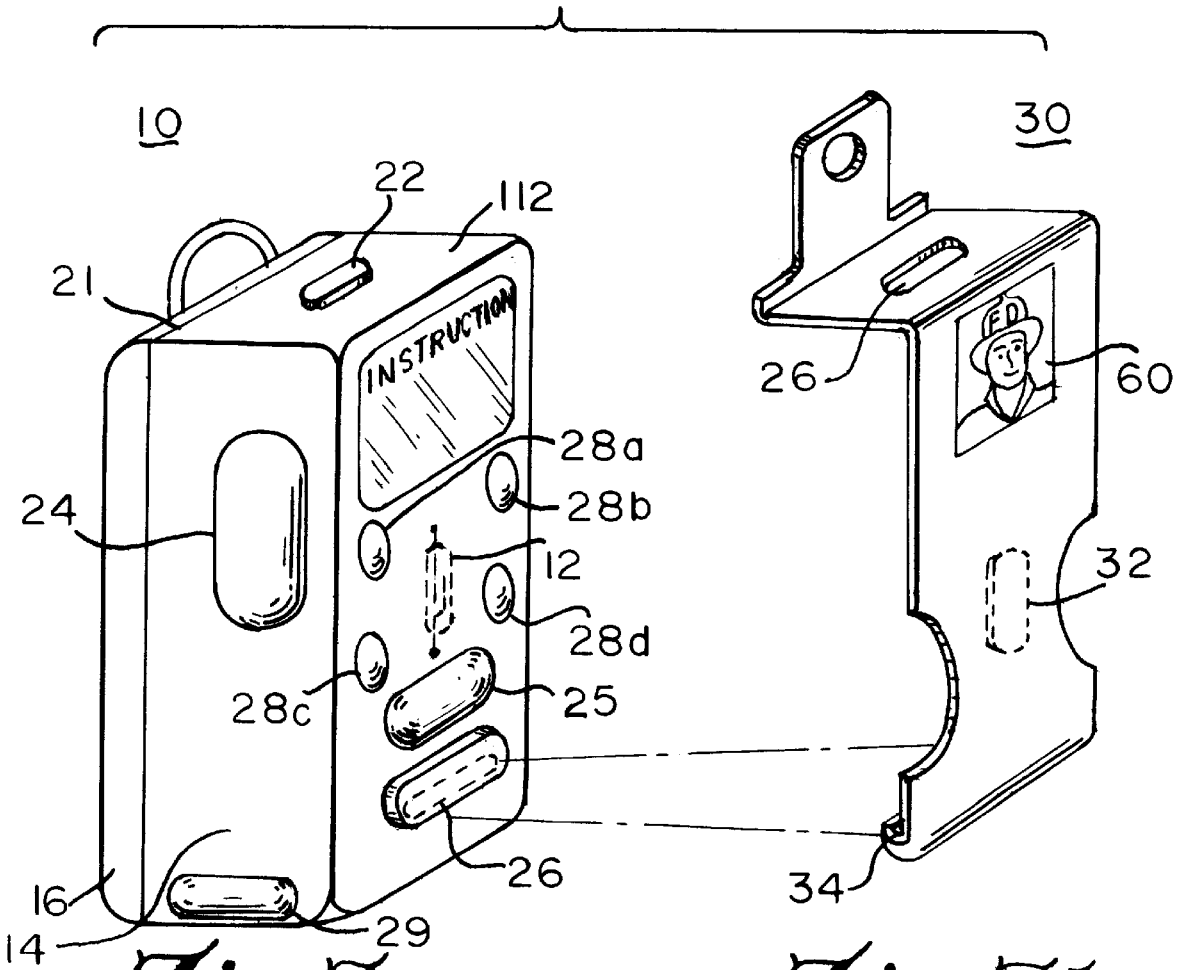
FIG. 1 is a front perspective view of the personal alarm device of this invention showing the exterior of the casing and some of the components of the alarm device.

The PASS alarm unit 10 is enclosed in a small size, multiple part waterproof case 112 made from high impact polycarbonate plastic, the dimensions of which are approximately 2" wide by 3.25" high by 1.5" deep. With battery, it weighs about six ounces. Case 112 has a main cup shaped front part 14 which encloses a battery, the electronic circuitry, which are assembled into the case 112 from the rear side are similar to those found in my U.S. Pat. No. 5,317,305 issued May 31, 1994 and are incorporated by reference. The case 112 is closed by an outside rear cover 16 which clamps an elastomeric, peripherally flat, gasket 18 against the peripheral back edge of the front cup-shaped part. Back cover 16 is secured by four screws 20*a*, 20*b*, 20*c*, and 20*d* which screw into embedded nut bodies molded into integral reinforcing ribs in the front part 14.

An internal back cover, made from the same kind of plastic as the case 112, is fitted into the back of the front part 14 and sealed in place by suitable waterproof adhesives, or glue, to enclose the interior electronic parts. The interior cover has a pocket recess which provides a receptacle for the 9 V battery that powers the unit 10. A standard 9 volt double terminal snap connector connected to the internal electronic circuitry by wires leading through an aperture in the base of the pocket provides the electric connection to battery. An adhesive is applied where the wires pass through the pocket wall to seal the passage in a waterproof manner.

Figure 6:
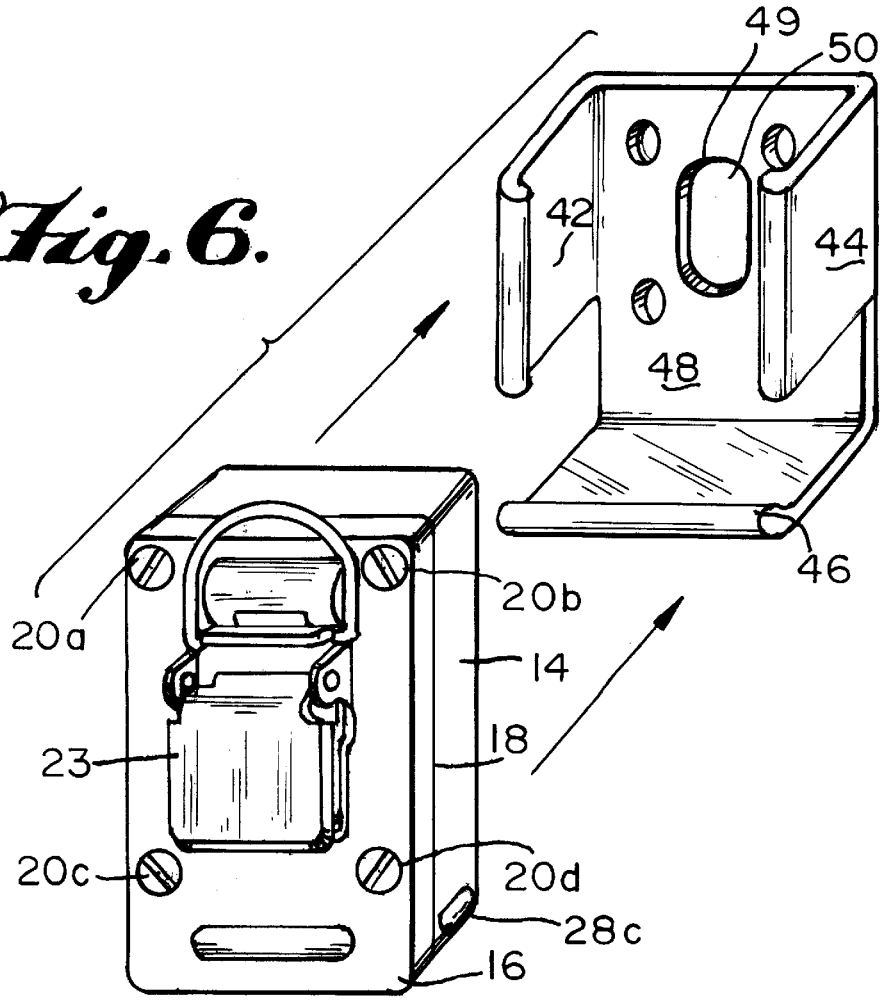
FIG. 6 is a perspective view of the personal alarm device and the holding bracket.

Various types of commercially available attachment devices can be fastened to clothing or a harness on the wearer, e.g., rings, captive clips and quick clamping grip clips, the latter being illustrated in FIG. 6 as grip clip 23.

Some of the external features which can be seen in FIG. 1 are the safety activator/deactivator buttons 24, an the emergency call button 25, a plurality of lens for color changing and pattern changing LEDs 28*a*, 28*b*, 28*c*, and 28*d*, and on either side of the unit 10 are sound and drain ports 29. Positioned below the two LEDs 28 is a key retaining slot 26. Activator buttons 24 are elostomeric flat grommet-like plugs which are placed into apertures in the walls of the front casing part 14 and provide a sealed fit. The buttons 24 engage actuators secured on the printed circuit board of the electronic circuitry as part of microprocessor system which is described in detail in my U.S. Pat. No. 5,317,305.

The two circular side wall ports 29 serve as part of the high intensity sound alarm system. The ports 29 also enable excellent drainage of any water that may enter the lower sound cavity in situations which the wearer may encounter.

With further reference to FIG. 1, this illustration depicts the PASS unit 10 that automatically turns on when the spring like key 30 is removed from the main body or front part 14 of the PASS alarm unit 10. Note that the tally key 30 is held in place by the key retaining slot 26, key retaining bump 22 and the spring action of the tally key 30. When the key 30 is removed from the PASS alarm unit 10, the unit activates and cannot be turned off unless the key 30 is returned to the pass alarm and the two side-buttons 24 are simultaneously pressed.

FIGS. 2 through 4 show the tally key 30. It is made of a tough, transparent polycarbonate plastic that has a permanent magnet 32 embedded in it. The magnet 32 magnetically infiltrates the reed switch when the tally key 30 is securely fastened to the casing front part 14. The tally key 30 is held in place by the spring action of this clip when attached to the front part 14 of the PASS unit 10 via the key retaining lip 34 and the key retaining bump 22 located on the PASS unit 10. The key 30 is attached to the PASS by placing the key, retaining lip 34 in the key retaining slot 26 and flexing the tally key 30 over the key retaining bump 22 located on the top side 21 of the PASS 10. Spring action of the flexed tally key 30 now holds the key in place. This tally key 30 may be tethered to any stationary object and when the PASS 10 is placed on one's person, the tally key 30 will snap off of the PASS unit and automatically activate the PASS.

The tally key 30 has an identification window 60 molded into it such that one may easily insert a photo of identification number in this window and secure it with the snap action of the ID window retaining clip. The identification window 60 provides a means for easily changing identification photos, numbers or bar coding and also provides a means of sealed protection for its contents. Further sealing of this ID window 60 may be achieved by placing a suitable sealing tape over the sealing clip if total waterproofing is desired.

Figure 5:
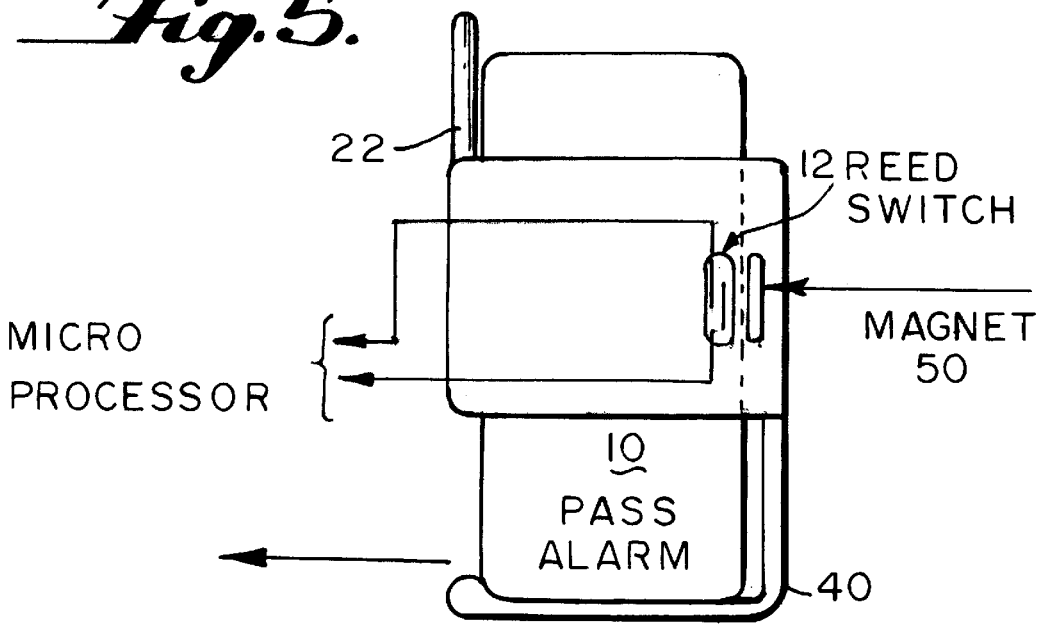
FIG. 5 is a side view of the personal alarm device in the holding bracket.

The holding bracket 40 illustrated in FIGS. 5 and 6 is used to store PASS alarm 10. The bracket 40 is made of a plastic material having properties similar to polycarbonate. It is incorporated by reference to U.S. Design patent application No. 29/077,368 filed on Sep. 22, 1998. The plastic material from which this device is made, must have a good spring action, be extremely rugged and able to withstand harsh environments. The dimensions of the holding bracket are 3.5 inches high by 2.0 inches deep and 2.25 inches thick. The material thickness is approximately 0.090 inches.

The PASS holding bracket 40 is fashioned such that sides 42 and 44 exhibit a spring action in combination with retaining lip 46. This arrangement results in a holder that grips the PASS unit 10 securely, yet permits easy removal of the PASS unit 10 from it's holder 40. In the center of back 48 is a retaining hole 49. The retaining hole contains an embedded magnet 50. The embedded magnet 50 is aligned with the reed switch 12 on the PASS alarm unit 10, so that when the PASS alarm unit 10 is securely positioned in the holder 40, the reed switch 12 is in magnetic contact with the embedded magnet 50 of the holder 40.

Under normal storage, the PASS alarm unit 10 is stored in it's holding bracket 40 and the magnetically activated reed switch 12 is held closed due to the presence of the magnetic field from the magnet 50. When the PASS unit 10 is removed from the holding bracket 40, the magnetically activated reed switch 12 opens and causes the pass alarm to activate. The alarm will remain in the ON state and cannot be turned OFF when absent from it's holding bracket 40. To turn the alarm off, it must be returned to the PASS holding bracket 40, resulting in the closing of the magnetic reed switch 12. When this switch closes, the alarm may be turned off by simultaneously depressing the two side buttons 24 on the PASS unit 10. It should be noted that two distinct actions are required. Namely, the PASS unit 10 must be in its holder 40 and both side buttons 24 must be pressed simultaneously. This action insures that the PASS unit 10 is not accidentally turned off.

Figure 7A:
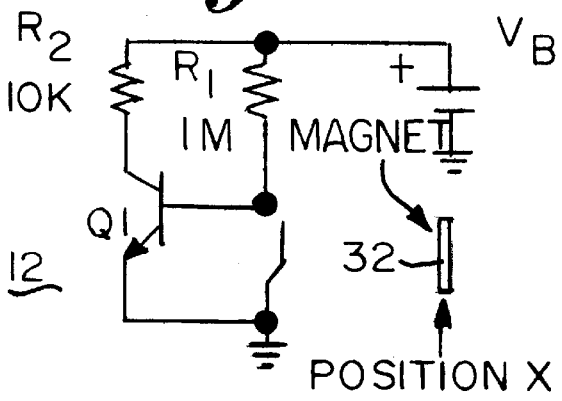
FIG. 7A is a schematic of the reed switch and magnet of the present invention in an open position.
Figure 7B:
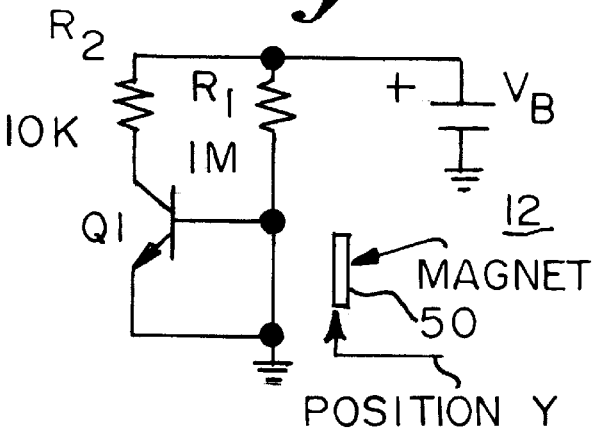
FIG. 7B is a schematic of the reed switch and magnet of the present invention in a closed position.

The theory of operation of the magnets 32 and 50 of the tally key 30 and the holder 40 are similar. Accordingly, FIGS. 7A and 7B illustrate the operations. Note that both of these schemes require that either the PASS device be absent from it's holding brackets, or the tally keys, when this occurs a safety officer can easily determine the number of tally keys or the number of empty holding brackets.

Reed switch 12 is closed in the presence of the magnetic field. This magnetic field is generated by the presence of either permanent magnet 32 or 50 affixed to the tally key 30 or holding bracket 40.

When the PASS 10 is removed from its holding bracket 40 or the tally key 30 is removed, the reed switch 12 will open sending the signal to the micro processor that generates an alarm.

A simple switch circuitry may be employed as depicted in FIGS. 7A and 7B.

With reference to 7A, when the magnet 32 or 50 is in position X, the reed switch 12 is open and the collector of Q1 is at or rear ground potential. Resistor R1 provides the necessary base current to activate Q1.

With reference to 7B, when the magnet 32 or 50 is in position Y, the reed switch 12 is closed due to the infiltration of the magnetic field. The base of Q1 is at ground potential and the collector of Q1 is at the supply voltage VB.

Figure 8A:
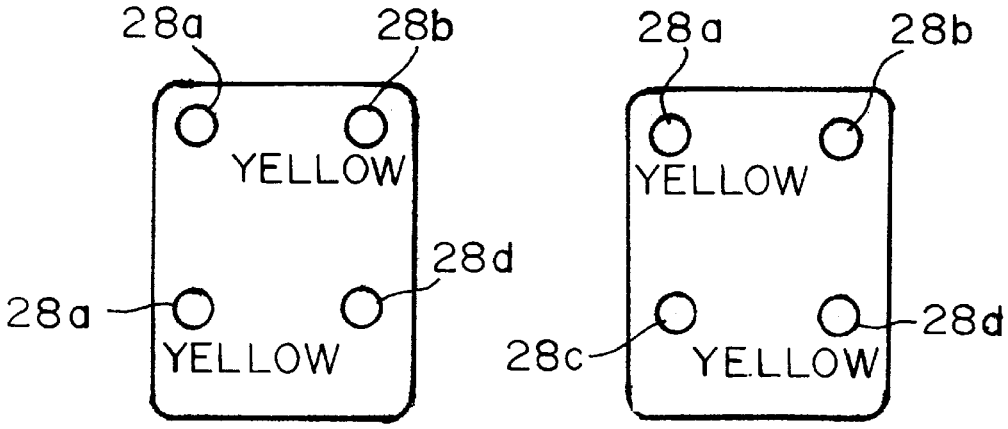
FIG. 8A illustrates a wig wag light pattern when motion is sensed.
Figure 8B:
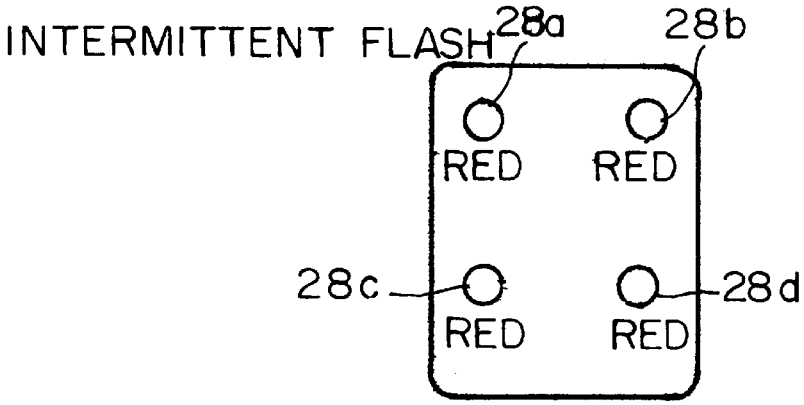
FIG. 8B illustrates an intermitted flash when lack of motion is sensed after eighteen seconds.
Figure 8C:
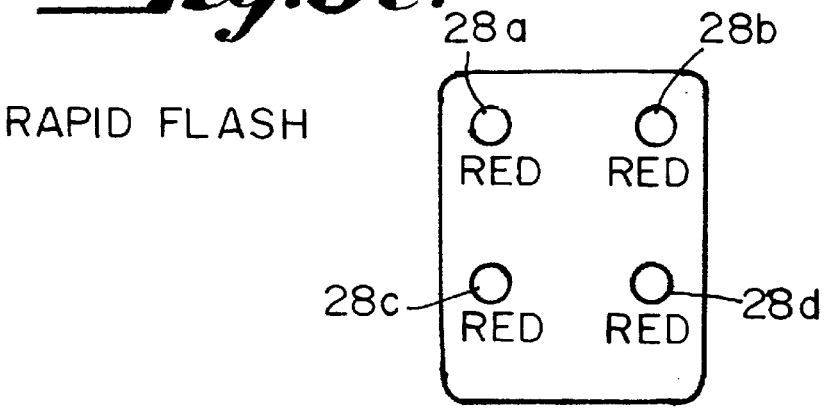
FIG. 8C illustrates a rapid flashing of lights when the PASS is in the alarm mode.

The visual patterns of LEDs 28*a*, 28*b*, 28*c*, and 28*d* are illustrated in FIGS. 8A, 8C and 8D. Each of these light sequences can be operated with or without audio tone. In the preferred embodiment, audio tone is utilized depending on the situation.

As shown in FIG. 8A, the light pattern is a wig wag pattern wherein LEDs 28*a* and 28*c* are on when LEDs 28*b* and 28*d* are off, and when LEDs 28*b* and 28*d* are on then LEDs 28*a* and 28*c* are off. This to and fro movement of the LEDs is utilized when motion is sensed. There is no audio tone during the wig wag light pattern.

When lack of motion of the PASS exceeds eighteen seconds, all four LEDs 28*a*, 28*b*, 28*c*, and 28*d* simultaneously flash red. As shown in FIG. 8B, this pattern and color changing of the LEDs is to provide an intermittent flash. This is intermittent flashing is accompanied by a series of pulsed audio tones that increase in frequency. The audio tones further alerts the wearer of the device that the PASS is about to alarm.

FIG. 8C illustrates a rapid flashing of lights when the PASS is in the alarm mode. In this mode, LEDS 28*a*, 28*b*, 28*c* and 28*d* are rapid flashing red lights. There is also a loud sweeping audio frequency accompanying the flashing LEDs.

While a specific embodiment has been illustrated and described, numerous modifications are possible without departing from the spirit of the invention, and the scope of protection is only limited by the scope of the accompanying claims.

What is claimed is:

1. A personal alert safety system having condition responsive sensor means and alarm means indicative of personal safety conditions comprising; a small size portable casing, said casing comprising an internal divided two part chamber, the first part being a watertight sealed cavity and the second part being a sound resonating cavity with surrounding walls including at least one sound port providing a passage from the interior to the exterior of said resonating cavity; a sealed flat wall means comprising a dividing wall between said two chamber parts electric and electronic control and operating circuitry means disposed in said first part of said chamber including a source of electric power, two series connected, single pole, push button control switches each having "on" and "off" positions and being spring biased to the "off" position, and flip-flop electronic switching means controlled by said control switches to enable said circuitry means to be turned "on" and "off" respectively by a sequence of simultaneous operations of said two control switches; said sealed flat wall means comprising a thin flat sound generating piezoelectric transducer device electrically connected to said circuitry means; a motion detector, and means rigidly mounted said motion detector within said first part of said two part chamber, said motion detector generating a sine wave voltage output a characteristic of which changes responsive to motion of said casing; and said circuitry means further including a tone oscillator, a rate oscillator and an amplifier, connected between said motion detector and said piezoelectric sound generating transducer and responsive to the output of said motion detector and said piezoelectric sound generating transducer and responsive to the output of said motion detector to cause a specific high intensity sweeping alarm signal to be emitted when the circuitry means is turned on and in the event that the casing is motionless, wherein improvement comprising:

said portable casing being semi-transparent and illuminating from within, the said illumination causing said portable casing to glow, change color or color pattern;

a key retaining bump positioned on a top portion of said semi-transparent casing;

a key retaining slot positioned on a bottom portion of said semi-transrarent casing;

a removable tethered spring loaded tally key having at least one embedded magnet and a retaining window, said at least one embedded magnet automatically causing the personal alert safety system to activate when said tethered spring loaded tally key is removed, an said retaining window accommodating unique identification means for uniquely identifying said tally key with the personal alert system; and a magnetically activating reed switch positioned on a front face portion of said semitransparent casing above said key retaining slot and electrically connected to said circuitry means for sensing the presence or absence of the magnetic field embedded in said tally key.

2. The personal alert safety system as defined in claim 1, wherein said magnetically activated reed switch further comprising:

a collector having a ground potential representing a first position, wherein said first position is an open position; and a base having a ground potential representing a second position, wherein said second position is a closed position.

3. The personal alert safety system as defined in claim 1, wherein said improvement further comprising:

at least four LEDs positioned between said key retaining bump and said key retaining slot; said LEDs for signaling at least three different sequences.

4. The personal alert safety system as defined in claim 3, wherein said first sequence being a wig wag pattern with said at least four LEDs alternating in pairs with two LEDs being on and said other two LEDs being off.

5. The personal alert safety system as defined in claim 4, wherein said second sequence being an intermittent flashing pattern such that after a period of time the at least four LEDs begin flashing accompanied by a series of pulsed audio tones that increase in frequency.

6. The personal alert safety system as defined in claim 5, wherein said third sequence being rapid flashing of said at least four LEDs and a loud sweeping audio frequency.

7. A personal alert safety system having condition responsive sensor means and alarm means indicative of personal safety conditions comprising: a small size semi-transparent portable casing, said semi-transparent casing comprising an internal divided two part chamber, the first part being a watertight sealed cavity and the second part being a sound resonating cavity with surrounding walls including at least one sound port providing a passage from the interior to the exterior of said resonating cavity; a sealed flat wall means comprising a dividing wall between said two chamber parts; electric and electronic control and operating circuitry means disposed in said first part of said chamber including a source of electric power, two series connected, single pole, push button control switches each having "on" and "off" positions and being spring biased to the "off" position, and flip-flop electronic switching means controlled by said control switches to enable said circuitry means to be turned "on" and "off" respectively by a sequence of simultaneous operations of said two control switches; said sealed flat wall means comprising a thin flat sound generating piezoelectric transducer device electrically connected to said circuitry means; a motion detector, and means rigidly mounted said motion detector within said first part of said two part chamber, said motion detector generating a sine wave voltage output a characteristic of which changes responsive to motion of said casing; and said circuitry means further including a tone oscillator, a rate oscillator and an amplifier, connected between said motion detector and said piezoelectric sound generating transducer and responsive to the output of said motion detector and said piezoelectric sound generating transducer and responsive to the output of said motion detector to cause a specific high intensity sweeping alarm signal to be emitted when the circuitry means is turned on and in the event that the casing is motionless, wherein improvement comprising:

a key retaining bump positioned on a top portion of said semi-transparent casing;

a key retaining slot positioned on a bottom portion of said semi-transparent casing;

a magnetically activated reed switch positioned on a front face portion of said semi-transparent casing above said key retaining slot and electrically connected to said circuitry means; and a tally key separately attachable to said semi-transparent casing, said tally key having at least one embedded magnet and a retaining window, said at least one embedded magnet automatically causing the personal alert safety system to activate when said tally key is removed, and said retaining window accommodating unique identification means for uniguely identifying said tally key with the personal alert system.

8. The personal alert safety system as defined in claim 7, wherein said magnetically activated reed switch further comprising:

a collector having a ground potential representing a first position, wherein said first position is an open position and in this first open position an alarm being turned on; and a base having a ground potential representing a second position, wherein said second position is a closed position and in this second closed position the alarm being turned off.

9. The personal alert safety system as defined in claim 8, wherein said tally key further comprising:

an inverted L-shape with a top portion having a retaining aperture, said retaining aperture able to securely mate with said retaining bump of said casing.

10. The personal alert safety system as defined in claim 9, wherein said tally key further comprising:

a bottom portion of said inverted L-shape having a retaining lip, said retaining lip for securely fitting into said retaining slot of said casing.

11. The personal alert safety system as defined in claim 10, wherein said tally key further comprising:

an embedded magnet for magnetically infiltrating said reed switch when said tally key is securely fastened to said casing.

12. A personal alert safety system having condition responsive sensor means and alarm means indicative of personal safety conditions comprising: a small size portable semi-transparent casing, said semi-transparent casing comprising an internal divided two part chamber, the first part being a watertight sealed cavity and the second part being a sound resonating cavity with surrounding walls including at least one sound port providing a passage from the interior to the exterior of said resonating cavity; a sealed flat wall means comprising a dividing wall between said two chamber parts; electric and electronic control and operating circuitry means disposed in said first part of said chamber including a source of electric power, two series connected, single pole, push button control switches each having "on" and "off" positions and being spring biased to the "off" position, and flip-flop electronic switching means controlled by said control switches to enable said circuitry means to be turned "on" and "off" respectively by a sequence of simultaneous operations of said two control switches; said sealed flat wall means comprising a thin flat sound generating piezoelectric transducer device electrically connected to said circuitry means; a motion detector, and means rigidly mounted said motion detector within said first part of said two part chamber, said motion detector generating a sine wave voltage output a characteristic of which changes responsive to motion of said casing; and said circuitry means further including a tone oscillator, a rate oscillator and an amplifier, connected between said motion detector and said piezoelectric sound generating transducer and responsive to the output of said motion detector and said piezoelectric sound generating transducer and responsive to the output of said motion detector to cause a specific high intensity sweeping alarm signal to be emitted when the circuitry means is turned on and in the event that the casing is motionless, wherein said improvement comprising:

a key retaining bump positioned on a top portion of said semi-transparent casing;

a key retaining slot positioned on a bottom portion of said semi-transparent casing;

a magnetically activated reed switch positioned on a front face portion of said semi-transparent casing above said key retaining slot and electrically connected to said circuitry means; and a holding bracket for receiving said semi-transparent casing, said holding bracket having a back portion, said back portion having an embedded magnet for magnetically infiltrating said reed switch when said semi-transparent casing is securely received by said holding bracket.

13. The personal alert safety system as defined in claim 12, wherein said magnetically activated reed switch further comprising:

a collector having a ground potential representing a first position, wherein said first position is an open position and in this first open position an alarm being activated; and a base having a ground potential representing a second position, wherein said second position is a closed position and in this second closed position the alarm being turned off.

14. The personal alert safety system as defined in claim 13, wherein said holding bracket further comprising:

a flexible L-shape with side portions extended as arms and each having a retaining lip for securely receiving said casing.

15. The personal alert safety system as defined in claim 14, wherein said holding bracket further comprising:

a bottom portion of said L-shape having a retaining lip, said retaining lip for securely receiving said casing.

* * * * *